US009314069B2

(12) United States Patent
Takazawa

(10) Patent No.: US 9,314,069 B2
(45) Date of Patent: Apr. 19, 2016

(54) TOP STOP FOR SLIDER

(75) Inventor: Shigeyoshi Takazawa, Macon, GA (US)

(73) Assignee: YKK Corporation (JP)

( * ) Notice: Subject to any disclaimer, the term of this patent is extended or adjusted under 35 U.S.C. 154(b) by 173 days.

(21) Appl. No.: 14/233,653

(22) PCT Filed: Jul. 19, 2012

(86) PCT No.: PCT/US2012/047333
§ 371 (c)(1),
(2), (4) Date: Jan. 17, 2014

(87) PCT Pub. No.: WO2013/013007
PCT Pub. Date: Jan. 24, 2013

(65) Prior Publication Data

US 2014/0157555 A1 Jun. 12, 2014

Related U.S. Application Data

(63) Continuation of application No. 13/186,814, filed on Jul. 20, 2011, now abandoned.

(51) Int. Cl.
*A44B 19/38* (2006.01)
*A44B 19/32* (2006.01)
*A44B 19/36* (2006.01)

(52) U.S. Cl.
CPC ..... *A44B 19/386* (2013.01); *A44B 19/32* (2013.01); *A44B 19/36* (2013.01); *Y10T 24/2598* (2015.01)

(58) Field of Classification Search
CPC ..... A44B 19/24; A44B 19/26; A44B 19/32; A44B 19/36; Y10T 24/2511; Y10T 24/2513; Y10T 24/2514; Y10T 24/2561; Y10T 24/2593; Y10T 24/2598
USPC ..... 24/385, 387, 388, 389, 393, 415, 433, 24/436
See application file for complete search history.

(56) References Cited

U.S. PATENT DOCUMENTS 2,923,992 A * 2/1960 Armstrong ..... A44B 19/32 24/387
3,409,953 A 11/1968 Briscoe
(Continued)

FOREIGN PATENT DOCUMENTS

CN 101380160 A 3/2009
EP 1992243 B1 2/2011
(Continued)

OTHER PUBLICATIONS

International Search Report, PCT Application No. PCT/US2012/047333, mailed Oct. 18, 2012.
(Continued)

*Primary Examiner* — Robert J Sandy
*Assistant Examiner* — David Upchurch
(74) *Attorney, Agent, or Firm* — Kilpatrick Townsend & Stockton LLP

(57) ABSTRACT

A top stop made of a flexible material and that cooperates with at least a portion of a slider body. The top stop includes a body having a fin that extends upwardly from the body and that includes a contour that generally conforms to a leading edge of the slider body. In some versions, the top stop has two extensions that project from the body and that form a gap that is configured to snugly receive a connecting neck of the slider body in such a way that water is prevented from penetrating the slider body.

18 Claims, 12 Drawing Sheets

(56) References Cited

U.S. PATENT DOCUMENTS

| | | | | |
|---|---|---|---|---|
| 3,505,710 | A | 4/1970 | Froehlich | |
| 3,959,858 | A * | 6/1976 | Fukuroi | A44B 19/36 24/435 |
| 4,232,431 | A | 11/1980 | Akashi | |
| 4,437,210 | A * | 3/1984 | Fukuroi | A44B 19/36 24/435 |
| 4,524,493 | A | 6/1985 | Inamura | |
| 4,825,514 | A | 5/1989 | Akeno | |
| 5,253,395 | A | 10/1993 | Yano | |
| 7,591,051 | B2 | 9/2009 | Kusayama et al. | |
| 2005/0204516 | A1 | 9/2005 | Leva et al. | |
| 2007/0067969 | A1 | 3/2007 | Kusayama et al. | |
| 2007/0074380 | A1 | 4/2007 | Matsumoto | |
| 2009/0019675 | A1 | 1/2009 | Peano | |
| 2014/0137375 | A1 | 5/2014 | Tanaka et al. | |
| 2014/0259560 | A1 | 9/2014 | Kojima | |
| 2015/0000087 | A1 | 1/2015 | Tanaka et al. | |

FOREIGN PATENT DOCUMENTS

| | | | |
|---|---|---|---|
| GB | 2199616 | A | 7/1988 |
| JP | S51-035204 | A | 9/1949 |
| JP | S63-103411 | A | 7/1975 |
| JP | S58-181209 | A | 12/1983 |
| JP | 63-13689 | | 4/1988 |
| JP | 5-3050 | | 1/1993 |
| JP | H05-001307 | A | 1/1993 |
| JP | 2003-180412 | A | 7/2003 |
| JP | 2008-284358 | A | 11/2008 |
| TW | 1309157 | | 5/2009 |

OTHER PUBLICATIONS

Office Action, Taiwanese Patent Application No. 101126383, mailed Jul. 14, 2014.

Written Opinion, PCT Application No. PCT/US2012/047333, mailed Oct. 18, 2012.

International Preliminary Report on Patentability, PCT Application No. PCT/US2012/047333, mailed Jan. 21, 2014.

Non-Final Office Action, U.S. Appl. No. 13/803,249, Feb. 12, 2015.

Office Action, Japanese Patent Application No. 2014-520414, mailed Mar. 24, 2015.

* cited by examiner

TOP STOP FOR SLIDER

CROSS-REFERENCE TO RELATED APPLICATIONS

This application is a national stage application of PCT/US2012/047333, which is a continuation application of U.S. application Ser. No. 13/186,814, both of which are incorporated herein by reference.

RELATED FIELDS

Water repellant top stops for interfacing with at least portions of a slider body of a slider.

BACKGROUND

A slider typically consists of a slider body and a pull tab. When the slider is pulled to one end of a tape, it contacts a component referred to as the "top stop" of the tape. A cover may be used to prevent water from entering any gaps that exist between the top stop and the slider. However, such a cover is an additional part and therefore requires extra time and expense for installation. As an alternative, the top stop can cooperate with a custom slider that has an enlarged top wing and an enlarged bottom wing, with the two enlarged wings extending over the diamond connecting the two wings. Portions of the enlarged wings overlap with the top stop and help eliminate any gaps between the slider and the top stop, thus helping to reduce the possibility for water to flow between the slider and the top stop. However, this configuration requires a custom-made slider, which increases costs.

SUMMARY

Disclosed are improved top stops that interface with standard sliders in a way that eliminates any gaps between the top stop and the standard slider. The cooperation of the improved top stop and the standard slider thus prevents water from penetrating through any gaps between the slider and the top stop. In some versions, the top stop is made of a flexible material and cooperates with at least a portion of a slider body. The top stop comprises a body having a fin that extends upwardly from the body and that includes a contour that generally conforms to a leading edge of the slider body. In some versions, the top stop comprises two extensions that project from the body and that form a gap that is configured to snugly receive a connecting neck of the slider body in such a way that water is prevented from penetrating the slider body.

Applicant does not wish to be bound by the forgoing or any other understanding of how its invention or any of the prior art works.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different figures is intended to illustrate like or analogous components.

DETAILED DESCRIPTION

Figure 1:
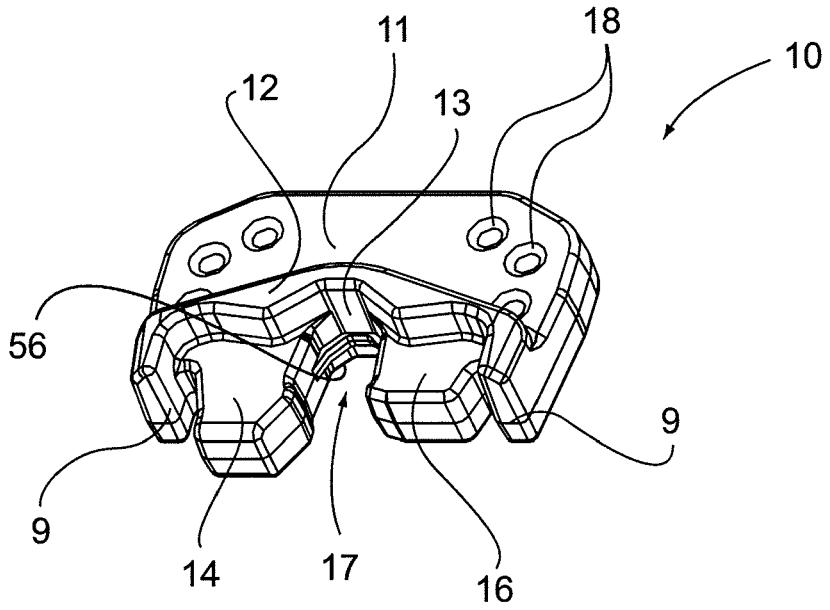
FIG. 1 is a perspective top view of a top stop according to one version.
Figure 2:
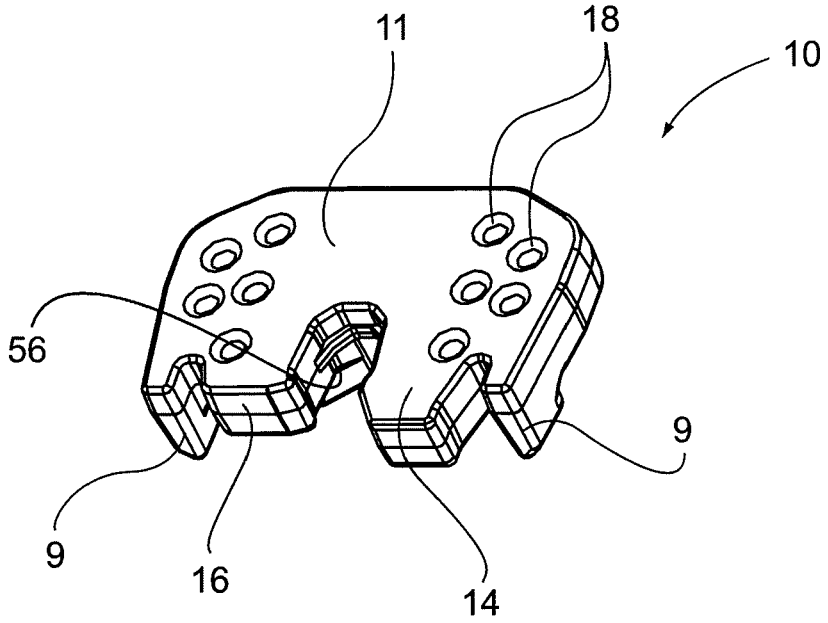
FIG. 2 is a perspective bottom view of the top stop of FIG. 1.

Disclosed are improved top stops for use with sliders. Top stop 10 is configured to cooperate with a conventional slider body, such as slider body 20 shown in FIGS. 6-9, to limit the traversal of the slider along a fastener tape, such as fastener tape 50 shown in FIG. 10. That is, by moving the slider body 20 in a direction approaching the top stop 10 and contacting the slider body 20 with the top stop 10, the further movement of the slider is restricted. In addition, top stop 10 is configured to engage with the slider body to form a slider assembly that does not have any gaps between the top stop and portions of the slider body so that water is prevented from penetrating the slider assembly. Slider assembly refers to a top stop 10 positioned with respect to the slider body 20 at one side end portion of element rows in which a plurality of elements are attached to opposing edge portions of a pair of left and right fastener tapes. The element rows engages with and disengages from each other by the movement of the slider. When the top stop 10 comes in contact with the slider body 20 and a part of the top stop 10 is inserted into the slider body 20 to engage with the slider body 20, the slider assembly is referred to as being in the engaged position, and when the top stop is disengaged with the slider body 20, the slider assembly is referred to as being in the disengaged position. The fastener tape 50 is comprised of a woven or knitted tape member and a film-like resin layer made of polyurethane, polyester, polyamide or vinyl chloride series thermoplastic elastomer and laminated on at least one of front and back surfaces of the tape member. When engaging, one row of the fastener elements is engaged with opposing row of the fastener elements and leading ends (end portions at a side of the opposing fastener tapes in a width direction) of the fastener elements come in contact with the opposing fastener tape and/or the resin layer to prevent water from passing through the element rows with the engagement. Hereinafter, the front-rear direction refers to a longitudinal direction of the fastener tape 50 which is the same direction as the movement direction in which the slider body 20 slides on the element rows. In particular, a direction in which the slider body 20 moves so as to engage the right and left element rows with each other to close the slide fastener is referred to as the front direction and a direction in which the slider body 20 moves so as to disengage the right and left element rows from each other to open the slide fastener is referred to as the rear direction. The left-right direction refers to a tape width direction of the fastener tape 50, which is parallel to the surface of the fastener tape 50 and perpendicular to the longitudinal direction of the fastener tape 50. In addition, the up-down direction refers to the front-back direction of the fastener tape 50, which is perpendicular to the surface of the fastener tape 50. In particular, a direction toward a side at which a pillar 34 of the slider body 20 is positioned with respect to the fastener tape 50 is referred to as the up direction and a direction opposite thereto is referred to as the down direction.

As is known, a slider cooperates with fastener elements (such as elements 52 shown in FIGS. 10-13) located on opposite sides of tape (such as fastener tape 50 shown in FIGS. 10-15) to open and close a zipper (slide fastener). A slider typically includes a slider body 20, and a pull tab (not shown) that attaches to the slider body in a known manner and serves as a handle when moving the slider. When the slider is moved in one direction, a Y-shaped channel (such as guide channel 44 located between a top wing (such as wing 30) and a bottom wing (such as wing 32)) of the slider body meshes the element row at one side of the fastener tape to the opposing element row. When the slider is moved in the opposite direction, the Y-shaped channel separates the rows of opposing elements.

Figure 8:
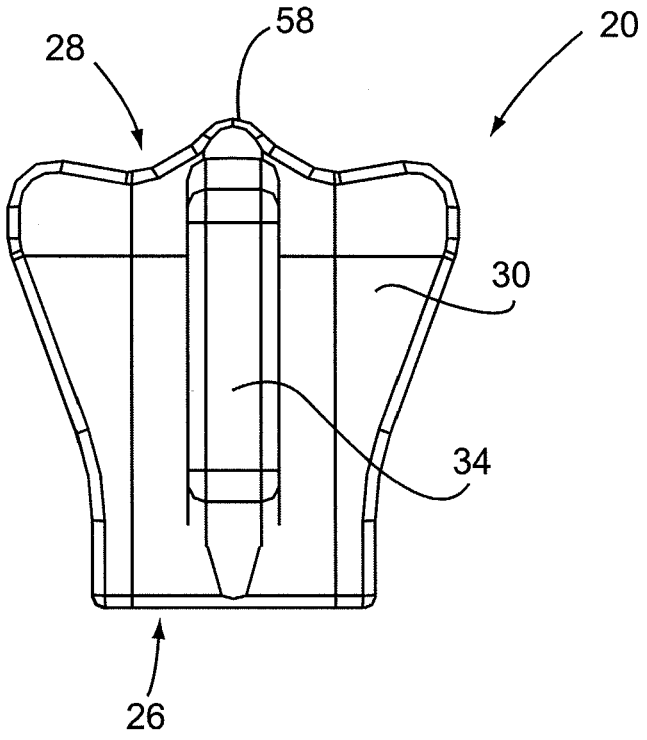
FIG. 8 is a top plan view of the slider of FIG. 6.
Figure 9:
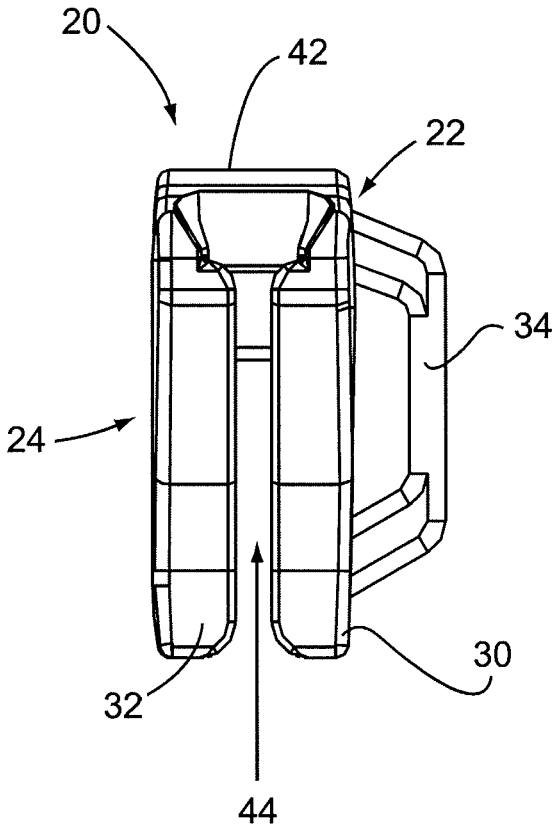
FIG. 9 is a side plan view of the slider of FIG. 6.
Figure 11:
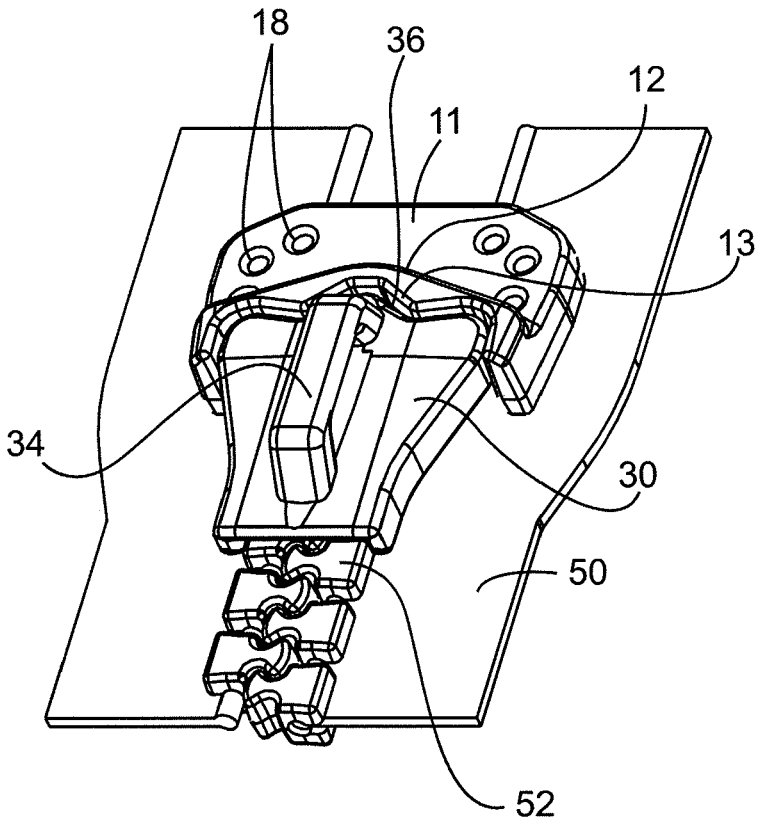
FIG. 11 is a perspective top view of the top stop of FIG. 1 and the slider of FIG. 6 in a state where the top stop is attached to the tape of FIG. 10, shown with the top stop and the slider in the engaged position.
Figure 12:
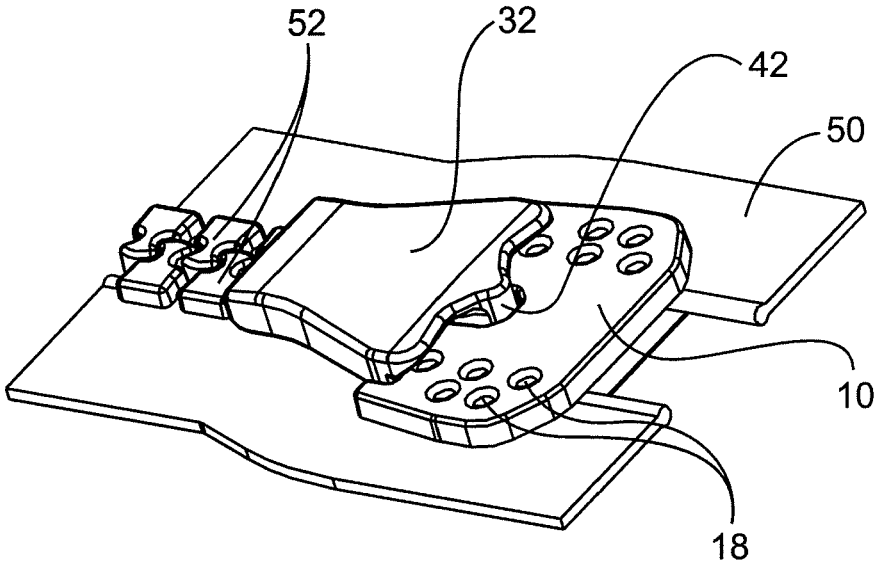
FIG. 12 is a perspective bottom view of the slider assembly of FIG. 10.
Figure 13:
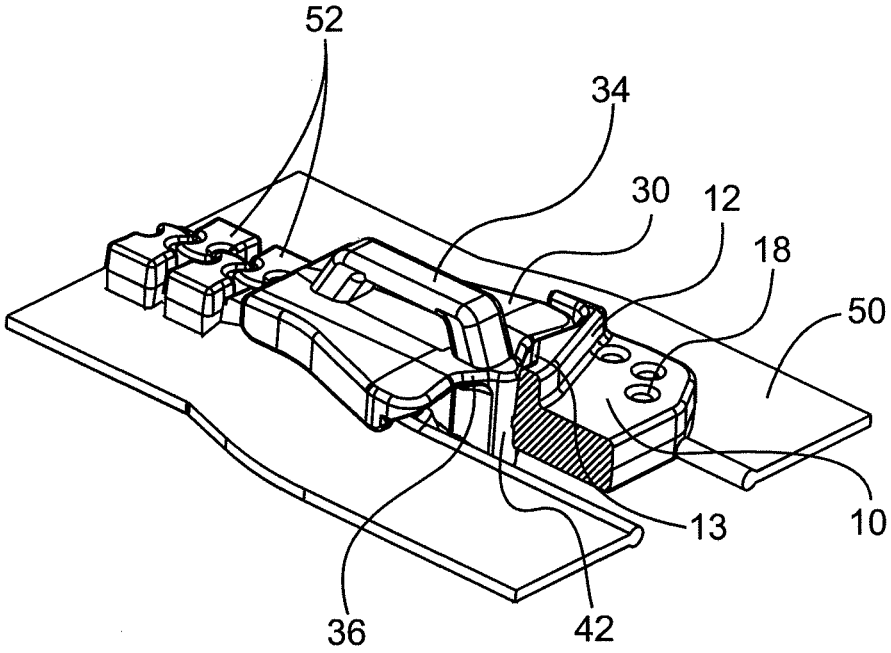
FIG. 13 is a partial perspective side view of the slider assembly of FIG. 11, shown with a portion of the top stop cut away.

When the slider is at one end of the element row, the slider body 20 is typically in a position to make contact with the top stop 10 (see FIG. 11, for example). As shown in FIGS. 8-9, slider body 20 has a top 22 (including the top wing 30 and the pillar 34), a bottom 24 (including the bottom wing 32), a front 28, and a rear 26. In the slider body 20 the top 22 and the bottom 24 are spaced apart from one another and joined at a side of the front 28 by a connecting neck 42 (sometimes referred to as a guide post) to form a Y-shaped guide channel 44. The connecting neck 42 includes a leading portion 58 (FIG. 8) projecting beyond the pillar 34 in the front direction. The top 22 has the pillar 34, around which a pull tab can be pivotably received, extends from the top wing 30 of the slider body 20. Slider body 20 can be of conventional construction so that the top and bottom wings are generally similar in shape and size, although they need not be. Moreover, the top and bottom wings are configured so they do not extend beyond the connecting neck 42 in the front direction, as shown in FIG. 9, for example.

FIGS. 1-5 illustrate a top stop 10 according to one version. Top stop 10 consists of a body 11 that may be formed of any suitable material, such as plastic or other suitable relatively soft material. In some versions, top stop 10 is formed of silicone or polyurethane materials. If formed of silicone, the silicone material may have a shore durometer of between around 25 and around 100 on the ASTM D2240 Type A scale (sometimes referred to as 25 A and 100 A in Type A scale). If formed of polyurethane, the polyurethane material may have a shore durometer of around 20 to around 95 on the ASTM D2240 Type A scale (sometimes referred to as 20 A and 95 A in Type A scale). Moreover, the polyurethane material may have a shore durometer of around 30 to around 90 on the ASTM D2240 Type D scale (sometimes referred to as 30 A and 90 A in Type A scale). In addition, as one example, the top stop 10 is flexible as compared with the element 52.

Figure 5:
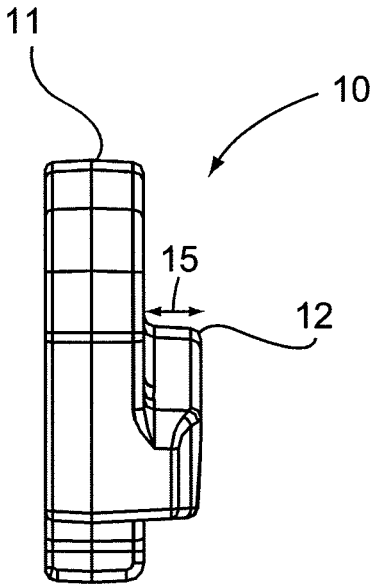
FIG. 5 is a side plan view of the top stop of FIG. 1.
Figure 15:
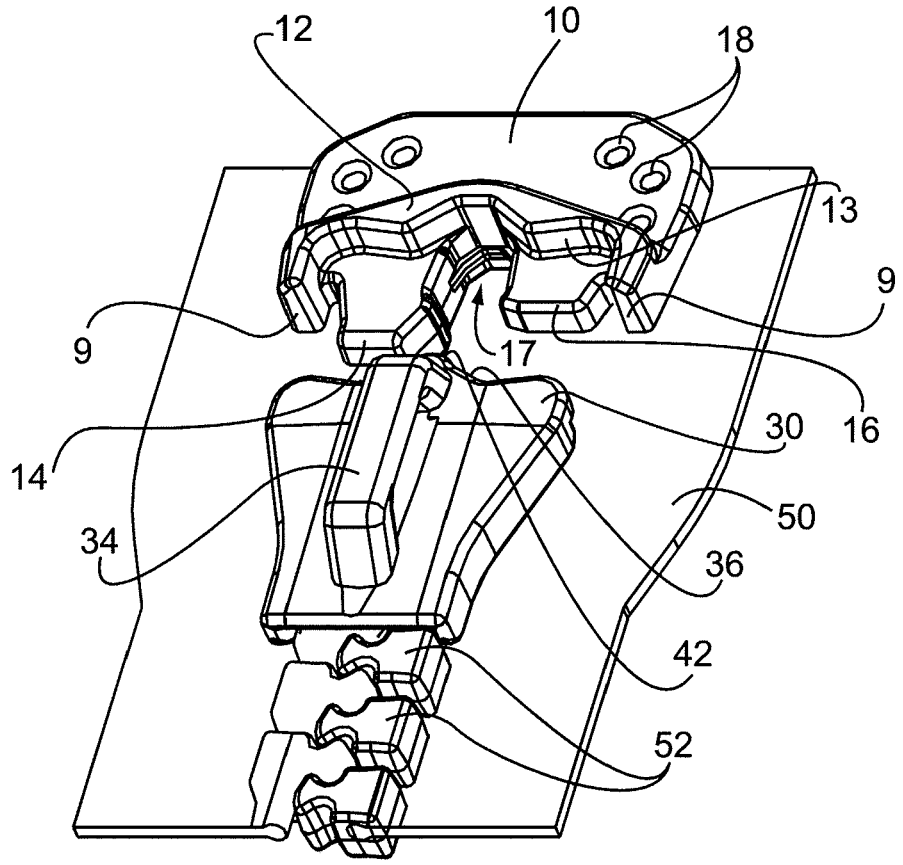
FIG. 15 is perspective top view of the top stop of FIG. 1 and the slider of FIG. 6 attached to the tape of FIG. 10, shown with the top stop and the slider in the disengaged position.

As shown in FIGS. 1-5, top stop 10 includes a fin 12 that projects generally upwardly from the body 11. In some embodiments, the fin 12 is formed of a flexible material and is relatively thin to increase flexibility (that is, the dimension of the fin 12 in the front-rear direction is less than the dimension of the body 11 in the front-rear direction). As illustrated in FIG. 5, the fin 12 may extend upwardly from the body 11 by a dimension 15. The dimension 15 is generally equivalent to the thickness of the top wing 30. In some versions, the fin 12 is a raised ridge that extends generally from the left end to the right end side of top stop 10 and directs water away toward the right edge or the left edge of the top stop 10 and away from the slider body 20 in a state where the top stop 10 is engaged. The fin 12 includes a contour 13 that generally conforms to the leading edge 36 of the slider body 20 (FIGS. 11, 15). Specifically, the contour 13 is shaped and sized to accommodate the connecting neck 42 of the slider body 20 and to accommodate the other parts of the front 28 of the bottom wing 32 (or the top wing 30 in other embodiments) of the slider body 20. Because contour 13 generally tracks the leading edge 36 of the slider body 20, including the connecting neck 42 of the slider body 20, water is restricted from penetrating into the slider assembly between the slider body 20 and the top stop 10 in a state where the slider body 20 and the top stop 10 are engaged with each other.

As shown in FIG. 1, a gap 17 is formed in the top stop 10 that accommodates the connecting neck 42 of the slider body 20. Gap 17 is formed between a first extension 14 and a second extension 16 that project from the body 11 in the rear direction. Gap 17 includes a lip 56 (shown in FIGS. 3 and 10), which the leading portion 58 of the connecting neck 42 of the slider body 20 abuts when the slider assembly is in the engaged position. Lip 56 is formed of a relatively thin (the dimension in the front-back direction is small and the dimension of the first extension 14 and the second extension 16 in the front-back direction is small), flexible material that can be compressed when the connecting neck 42 abuts it, and is thus configured to accommodate variations in the size/shape of the connecting neck 42.

Figure 10:
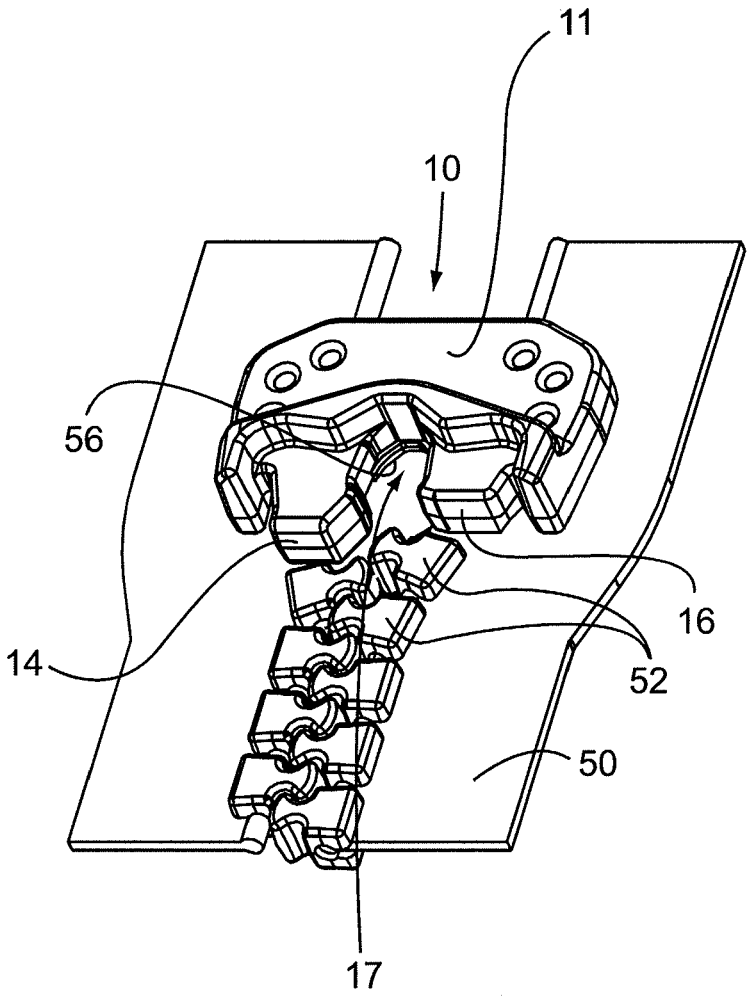
FIG. 10 is a perspective top view of the top stop of FIG. 1 in a state where the top stop is attached to a tape.

As shown in FIG. 10, when top stop 10 is engaged with a tape, such as the fastener tape 50, first extension 14 is positioned adjacent to an element 52 at one side of the fastener tape 50. On the other hand, second extension 16 is positioned adjacent to another element 52 (an element 52 at another side of the fastener tape 50, also referred to as the second element) that is generally more toward an end of tape 50. Although as illustrated first extension 14 projects further than an end portion of second extension 16 so that the first extension 14 is formed longer than the second extension 16, it is envisioned that second extension 16 could project further than an end portion of first extension 14, depending on the configuration of the elements 52 of the tape 50. In general, the amount of projection (the length in the front-rear direction, the dimension extending from the body 11) of each of the extensions 14, 16 depends on the positioning of the elements 52. In some embodiments, extensions 14, 16 do not contact elements 52, but project toward them. The extensions 14, 16 may be in contact with the elements 52. In addition, as shown in FIG. 10, the body 11, the first and second extensions 14, 16 and projections 9 of the top stop 10 disposes the fastener tape at the midpoint thereof in the front-back direction. In other words, the body 11, the first and second extensions 14, 16 and the projections 9 of the top stop 10 are formed on two sides of the fastener tape 50.

Figure 3:
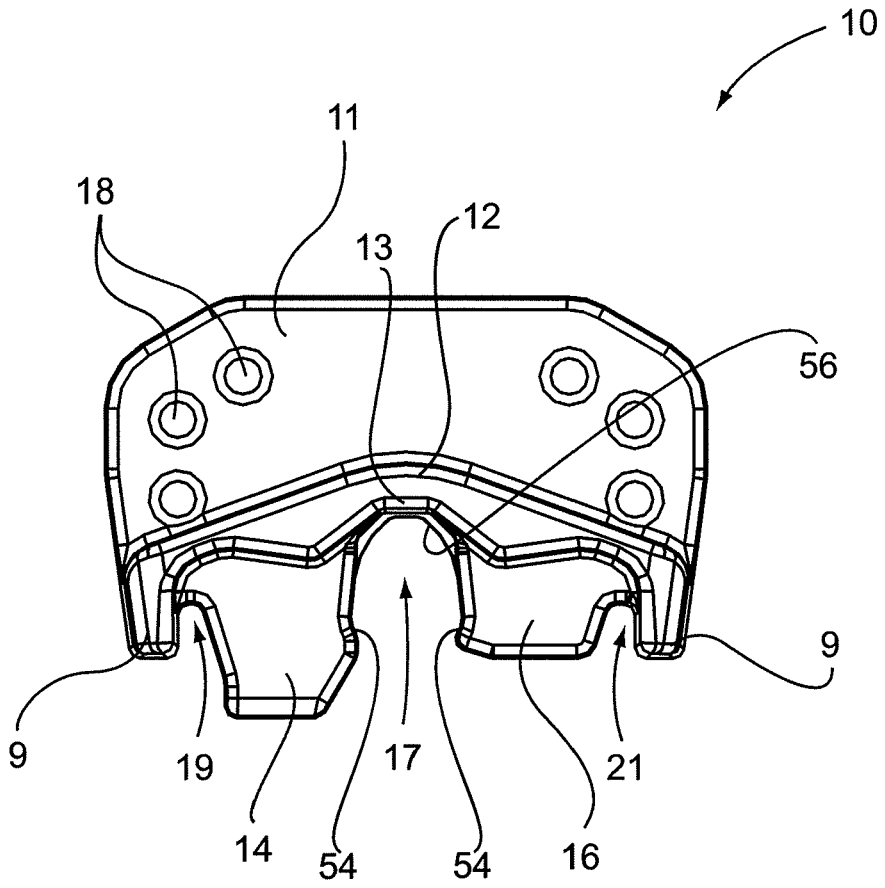
FIG. 3 is a top plan view of the top stop of FIG. 1.
Figure 4:
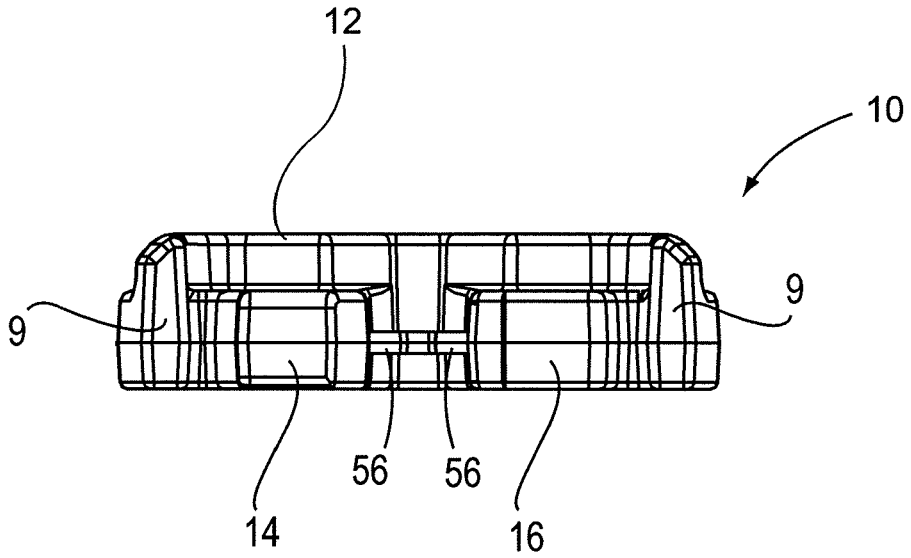
FIG. 4 is a rear plan view of the top stop of FIG. 1.

Top stop 10 also includes two projections 9 that project rearward from end portions of the body 11 in the left-right direction. In FIG. 3, the projection disposed at the left side in the paper is referred to as first projection and the projection disposed at the right side in the paper is referred to as second projection. Gaps 19, 21 formed between each projection 9 and the extensions 14, 16 (i.e. between the first projection 9 and the first extension 14 or between the second projection 9 and the second extension 16) accommodate the flange 38

Figure 6:
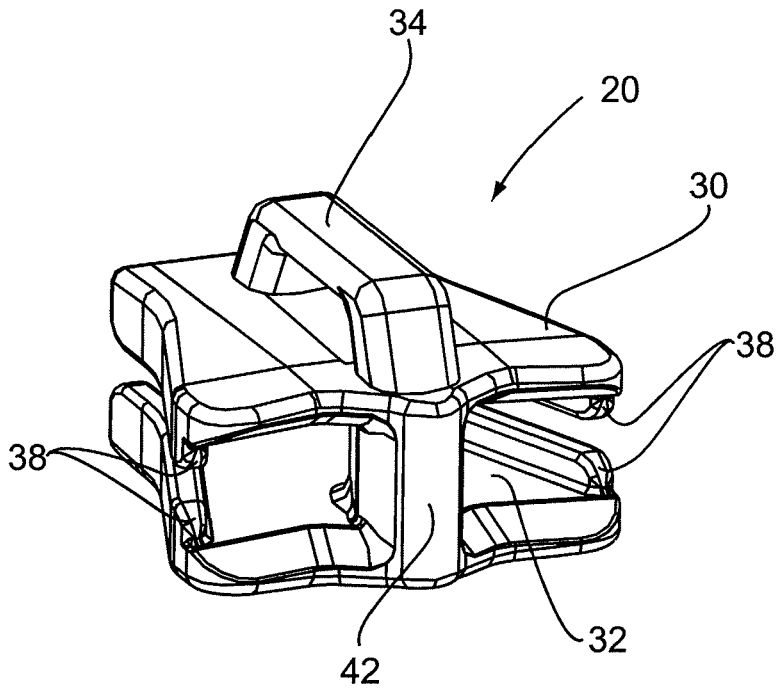
FIG. 6 is a perspective front view of a conventional slider.
Figure 7:
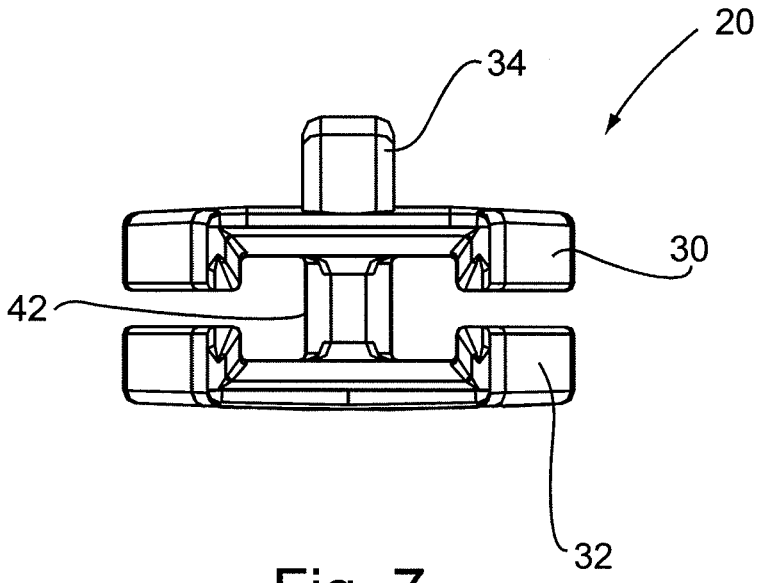
FIG. 7 is a rear plan view of the slider of FIG. 6.

(portions extending from the respective wings 30, 32 in a direction approaching each other in FIG. 6) of the slider body 20 and help eliminate any gaps between the top stop 10 and the flanges 38 of the slider body 20. In FIG. 3, the gap 19 disposed at the left side in the paper is referred to as first gap and the gap 21 disposed at the right side in the paper is referred to as the second gap. First flange 38 is accommodated in the first gap and the second flange 38 is accommodated in the second gap.

Top stop 10 also includes a plurality of holes 18, through which top stop 10 can be attached to fastener tape 50 by injection molding techniques or other suitable techniques. Each of the holes 18 is a hole connecting the surface of the body 11 and the surface of the fastener tape 50. If injection molding is used, the fastener tape 50 is positioned in the front-back direction in a mold with a cylindrical pin to prevent the fastener tape 50 from being misaligned by the liquid/molten material used to form top stop 10 in the mold and the holes 18 make the material therearound more likely to be cooled and thus a stronger engagement can be obtained between top stop 10 and fastener tape 50 after the material solidifies.

Figure 14:
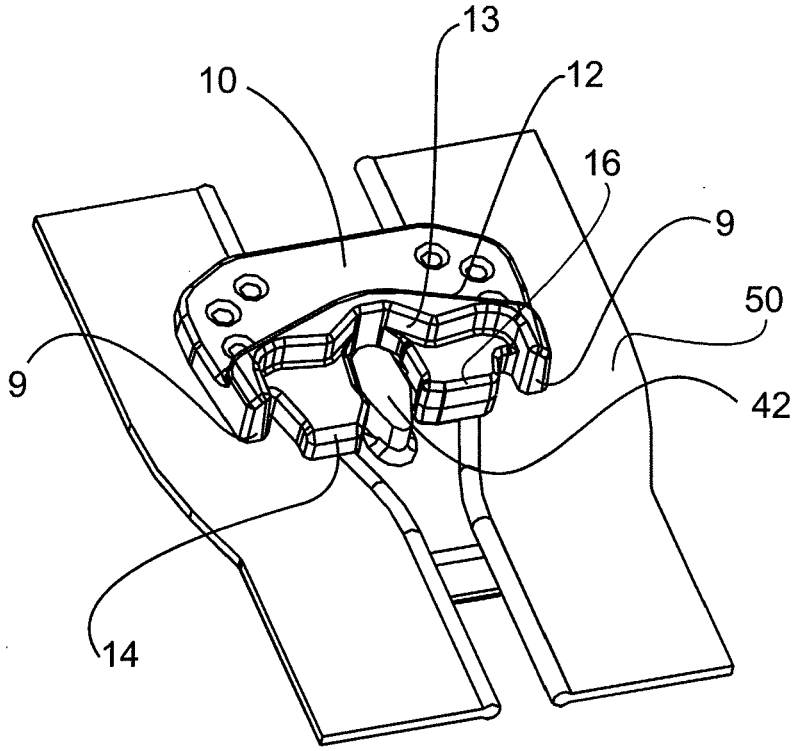
FIG. 14 is a partial perspective top view of the top stop of FIG. 1 attached to the tape of FIG. 10, in a state where only the slider of FIG. 11 is cut horizontally with respect to a guide post.

As mentioned above, top stop 10 is configured to cooperate with slider body 20 by engaging the front 28 of the slider body 20 (FIG. 8) and the connecting neck 42 of the slider body 20. Specifically, gap 17 is configured so that connecting neck 42 is snugly received within gap 17 of the top stop 10. In this way, the shape and width of the gap 17 is determined by the dimensions of the connecting neck 42. As shown in FIG. 3, the first and second extensions 14, 16 each have a slight bend 54 in the gap 17 toward the body 11 to accommodate the shape of the connecting neck 42. Bends 54 reduce the size of the gap 17 such that the dimension of the gap 17 in the left-right direction first increases and then reduces toward the body 11. When the connecting neck 42 is received within gap 17, lip 56 comes in contact with the leading portion 58 of the connecting neck 42 to be compressed due to the properties of the lip 56 and deforms so as to conform to the shape of the leading portion 58. This compression around the connecting neck 42 eliminates any gaps between the top stop 10 and the connecting neck 42 that may arise due to variances in the shape of the lip 56, the contour 13, the connecting neck 42 or its leading portion 58, and/or other portions of the slider body 20. As such, the first and second extensions 14, 16 outline the connecting neck 42 and prevent water from penetrating into the slider body 20, as shown in FIG. 14.

When the slider assembly is in the engaged position (FIG. 11), the slider body 20 locks with the top stop 10. In some versions, the length, height, and shape of the first and second extensions 14, 16, including the presence of bend 54, helps secure the slider body 20 in the locked position, which prevents the slider body 20 from disengaging with the top stop 10 under certain loads.

In the above slider assembly, the top stop 10 may be used with any type of zipper such as injection molded type of zippers in which the elements are formed by injection-mold the synthetic resin, coil type of zippers which is comprised of a coil-shaped monofilament, or metal type of zippers made of metal. Top stop 10 may be used with any suitable product, including, but not limited to, clothing, bags, pockets, chemical protection suits, wet and dry suits, and/or outdoor clothing and gear. Because the top stop prevents water from penetrating gaps between the top stop 10 and the slider body 20, an additional flap or piece of clothing is not necessary to cover the assembly.

Numerous modifications of this invention may be made in the composition, application, manufacturing process and other aspects of this invention without departing from the objectives and spirit of the description above and in the Figures.

The invention claimed is:

1. A slider assembly comprising:

(a) a slider body comprising a top wing and a bottom wing that are spaced apart from one another and joined by a connecting neck, wherein each of the top and bottom wings comprises a leading edge that extends along a front of the slider body; and (b) a top stop comprising:

a body comprising a fin that extends upwardly from the body and that extends from a left side to a right side of the body, wherein the fin comprises a contour that conforms to the leading edge of the slider body;

two extensions that project from the body, wherein a first extension of the two extensions projects beyond a second extension of the two extensions;

a gap formed between the two extensions, wherein the gap is dimensioned to receive the connecting neck of the slider body, and wherein the body of the top stop further comprises a plurality of holes.

2. The slider assembly of claim 1, wherein the top stop further comprises two projections that project from the body of the top stop, wherein a first gap formed between a first projection of the two projections and the first extension of the two extensions is dimensioned to receive a first flange of the slider body and wherein a second gap formed between a second projection of the two projections and the second extension of the two extensions is dimensioned to receive a second flange of the slider body.

3. The slider assembly of claim 1, wherein the contour of the top stop contacts the connecting neck of the slider body and at least one of the leading edges of the top and bottom wings of the slider body.

4. The slider assembly of claim 1, wherein the top stop is formed of silicone or polyurethane.

5. The slider assembly of claim 4, wherein the top stop has a durometer hardness of about 20 A to about 95 A.

6. The slider assembly of claim 1, wherein the top and bottom wings do not extend beyond the connecting neck.

7. The slider assembly of claim 1, wherein each of the two extensions further comprises a bend that reduces a size of the gap formed between the two extensions.

8. The slider assembly of claim 1, wherein the gap formed between the two extensions comprises a lip that comes in contact with a leading portion of the connecting neck of the slider body.

9. A slider assembly having an engaged position and a disengaged position, the slider assembly comprising:

(a) a slider body comprising a top wing and a bottom wing that are spaced apart from one another and joined by a connecting neck, wherein each of the top and bottom wings comprises a leading edge that extends along a front of the slider body; and (b) a top stop comprising:

a body comprising a fin that extends laterally across the body of the top stop, wherein the fin comprises a contour that conforms to the leading edge of at least one of the top and bottom wings of the slider body and wherein, when the slider assembly is in the engaged position, the contour contacts the leading edge of at least one of the top and bottom wings;

two extensions that project from the body of the top stop, wherein a first extension of the two extensions projects beyond a second extension of the two extensions, wherein, when the slider assembly is in the engaged position, the first extension of the two extensions approaches a first element of one of fastener tapes and the second extension of the two extensions approaches a second element of another of the fastener tapes; and a gap that is formed between the two extensions, wherein, when the slider assembly is in the engaged position, the connecting neck of the slider body is snugly received within the gap, and wherein the body of the top stop further comprises a plurality of holes.

10. The slider assembly of claim 9, wherein the fin is formed of a flexible material.

11. The slider assembly of claim 9, wherein the top stop further comprises two projections that project from the body of the top stop, wherein a gap is formed between each of the two projections and each of the two extensions, wherein, when the slider assembly is in the engaged position, a flange of the slider body is received within the gap formed between each of the two projections and each of the two extensions.

12. The slider assembly of claim 9, wherein the top stop is formed of silicone or polyurethane.

13. The slider assembly of claim 12, wherein the top stop has a durometer hardness of about 20 A to about 95 A.

14. The slider assembly of claim 9, wherein the bottom wing and the top wing are substantially the same size and shape and do not extend beyond the connecting neck of the slider body.

15. The slider assembly of claim 9, wherein the gap formed between the two extensions comprises a lip that generally conforms to a leading portion of the connecting neck of the slider body and that compresses around the connecting neck when the slider assembly is in the engaged position.

16. A top stop comprising:

a body comprising a fin that extends upwardly from the body and that extends laterally across the body, wherein the fin comprises a contour that conforms to a leading edge of a slider body;

two extensions that project from the body, wherein a first extension of the two extensions projects beyond a second extension of the two extensions;

a gap formed between the two extensions, wherein the gap is dimensioned to receive a connecting neck that extends between a top wing and a bottom wing of the slider body, wherein a lip of the gap conforms to a leading portion of the connecting neck; and two projections, wherein a first gap formed between a first projection of the two projections and the first extension of the two extensions is dimensioned to receive a first flange of the slider body and wherein a second gap formed between a second projection of the two projections and the second extension of the two extensions is dimensioned to receive a second flange of the slider body, and wherein the body of the top stop further comprises a plurality of holes.

17. The top stop of claim 16, wherein the top stop is formed of silicone or polyurethane.

18. The top stop of claim 17, wherein the top stop has a durometer hardness of about 20 A to about 95 A.

* * * * *